US006026982A

United States Patent [19]

Caruthers

[11] Patent Number: 6,026,982

[45] **Date of Patent: *Feb. 22, 2000**

[54] NON-GRIP HOLDER FOR CONTAINERS

[75] Inventor: Scott Caruthers, Westminster, Md.

[73] Assignee: Dar Products Corporation, Owings Mills, Md.

[ * ] Notice: This patent is subject to a terminal disclaimer.

[21] Appl. No.: 08/932,122

[22] Filed: Sep. 17, 1997

Related U.S. Application Data

[63] Continuation-in-part of application No. 08/493,785, Jun. 22, 1995, Pat. No. 5,671,864.

[51] Int. Cl.[7] ..... B65D 23/10

[52] U.S. Cl. ..... 220/737; 220/771; 220/752; 220/772

[58] Field of Search ..... 220/737, 771, 220/752, 772, 758, 756, 755

[56] References Cited

U.S. PATENT DOCUMENTS

| | | | |
|---|---|---|---|
| D. 153,887 | 5/1949 | Macaulay . | |
| 2,586,199 | 2/1952 | Backus | 65/13 |
| 3,198,377 | 8/1965 | Buckley | 220/94 |
| 4,165,896 | 8/1979 | Hunt | 294/25 |
| 4,523,781 | 6/1985 | Brody | 294/1.1 |
| 4,602,885 | 7/1986 | Bischoff et al. | 401/6 |
| 4,606,484 | 8/1986 | Winter et al. | 224/218 |
| 4,909,392 | 3/1990 | Williams et al. | 220/509 |
| 5,009,416 | 4/1991 | Caruthers | 272/143 |
| 5,076,438 | 12/1991 | Aronson | 206/557 |
| 5,199,587 | 4/1993 | Ota et al. | 215/1 C |
| 5,207,338 | 5/1993 | Sandhu | 220/771 |
| 5,353,952 | 10/1994 | Donche | 220/575 |
| 5,671,864 | 9/1997 | Caruthers | 220/772 |

*Primary Examiner*—Joseph M. Moy
*Attorney, Agent, or Firm*—Leonard Bloom

[57] ABSTRACT

A holder for a container which is attached to the side of the container. The holder has an outer wall which, with the side of the container, defines a chamber therebetween with an opening to the chamber. The user's hand is inserted in the opening such that a forceful grip is not required to pick up and hold the container. The holder is electromagnetically welded or otherwise joined to the container. The holder is also formed on a zarf. A two-handed holder for the container permits both hands of the user to hold the container with a forceful grip not required.

23 Claims, 18 Drawing Sheets

NON-GRIP HOLDER FOR CONTAINERS

CROSS REFERENCE TO RELATED APPLICATIONS

This application is a continuation-in-part of application Ser. No. 08/493,785 filed Jun. 22, 1995 (U.S. Pat. No. 5,671,864), the disclosure of which is incorporated by reference herein in its entirety.

FIELD OF THE INVENTION

The present invention relates to a container having a holder and to a holder for a container and, in particular, to a holder in which the user's hand is disposed such that a forceful grip is not necessary to pick up and hold the container.

BACKGROUND OF THE INVENTION

The cup or pitcher having an ear-like handle is widely known and used. The handle is usually grasped with several of the user's fingers being inserted into the opening between the cup and the handle so that the handle is adjacent to the palm of the user's hand and the user's fingers grip the handle. Persons with arthritic conditions, or other manual disablements which reduce the dexterity of their fingers, have difficulties picking up and holding a cup full of material such as coffee or sugar. This problem is exacerbated if the cup contains a hot liquid which, if spilled, could cause injuries to the user. Persons without any physical problems have difficulties picking up larger containers such as the common pitcher containing a quart of liquid. Frequently, pouring cannot be accomplished with one hand and two hands are required.

The applicant is aware of devices which have been proposed to assist persons with manual disablements as follows:

| U.S. Pat. No. | Inventor(s) |
|---|---|
| 4,165,896 | Hunt |
| 4,523,781 | Brody |
| 4,602,885 | Bischoff et al |
| 4,606,484 | Winter et al |

However, all of these devices are directed to an attachment to the hand of the user rather than to the container or object to be held or manipulated.

The present invention is also useful for persons who do not have disablements. The only devices of which the applicant is aware which are directed to non-grip holding are the following U.S. Pat. Nos. 4,813,669; 4,880,228; 4,896,880; 4,900,016; 5,139,472; 5,302,165; 5,342,268; 5,346,450; and 5,496,244, all of which are inventions of the applicant and are directed to exercise devices. U.S. Pat. No. 5,009,416 issued to Caruthers discloses a grip facilitating handle for equipment including exercise devices, crutches, power tools, hand tools, motorcycles, and microprocessor controls and is especially useful in reducing fatigue associated with manipulation or control of the equipment, apparatus. The handle can be used as a retrofit for existing equipment.

However, none of the known handles or devices have been suggested for use with a container such as an ordinary cup, mug or pitcher, which are in everyday use.

U.S. Pat. No. 2,586,199 to Backus discloses a handle for vessels which is grasped with the palm of the hand outside of the handle and the fingers inserted within the handle. U.S. Pat. No. Des. 153,887 to Macaulay discloses a cup with a handle which is held in a manner similar to the Backus reference.

A need exists for a simple, energy efficient holder for a container.

BRIEF SUMMARY OF THE INVENTION

It is a primary object of the present invention to provide a holder for a container wherein a user may pick up and hold the container by inserting a hand within the holder without gripping the container.

It is another object of the present invention to provide a method for forming a container which the user can hold without gripping the container.

It is a further object of the present invention to provide a zarf which the user can hold without gripping the container.

In accordance with the teachings of the present invention, there is disclosed herein a container to be picked up and held by a hand of a user. The container has an outer wall and a holder radially disposed on the outer wall of the container. The holder has a wall having a substantially U-shaped cross-section. A chamber is formed between the outer wall of the container and the wall of the holder. The chamber has an opening, and is closed at a point distal from the opening. The wall of the holder has a concave inner surface. When the user's hand is inserted in the opening, the user's hand is substantially in a curved natural, at rest open position with the palm and extended fingers being around the outer wall of the container and the wall of the holder such that human effort is reduced and a forceful grip is not necessary to pick up and hold the container.

In further accordance with the teachings of the present invention, there is disclosed a container in combination with a holder for the container. The holder does not require a forceful grip for the picking up and holding of the container. The container has an outer wall, the holder being substantially unitary and having a wall. The holder is disposed radially on the outer wall of the container defining a chamber therebetween. An opening is formed between the wall of the container and the wall of the holder, the opening communicating with the chamber for providing access for the user's hand. The chamber has a vertical dimension smaller than a perimeter dimension around the wall of the holder, such that the user's hand is disposed in the chamber between the outer wall of the container and the wall of the holder. The palm of the user's hand substantially rests on the outer wall of the container, and the back of the user's hand substantially confronts the inner surface of the wall of the holder. In this manner, the user's hand is substantially in a curved natural, at rest position, rather than being tightly closed, thereby substantially reducing the human effort and energy required to pick up and hold the container. The outer wall of the container and the wall of the holder are joined together at an outer extremity of the holder forming a closed chamber, the chamber gradually having a more narrow dimension between the outer wall of the container and the wall of the holder in the direction from the opening to the outer extremity of the holder.

There is also disclosed a container to be held by a hand of a user such that a forceful grip is not necessary to pick up and hold the container, the container comprising a cylinder having a circumferential wall, a bottom and an open top, an outer wall having a substantially U-shaped cross-section disposed circumferentially of the cylinder wall and joined to the wall of the cylinder forming a closed chamber therebetween, the chamber having an opening, the outer wall having a convex inner surface, whereby when the user's hand is inserted into the opening, the user's hand is substantially curved about the wall of the cylinder and disposed between the convex inner surface of the outer wall and the wall of the cylinder.

In another aspect, there is disclosed a method of use of a container to enable said container to be picked up and held by a hand of a user such that a forceful grip is not required. The container has an outer wall which is cylindrical or otherwise tapers from a top portion to a bottom portion of the container. A holder is formed on the outer wall of the container. The holder has a wall disposed radially of and substantially parallel to, the wall of the container, such that a closed chamber having an opening is formed between the outer wall of the container and the wall of the holder. The wall of the holder has a top portion adjacent to the container. The method includes the steps of inserting the extended fingers and the palm of the user's hand into the opening. The extended fingers and the palm of the user's hand are received within the chamber supporting the top portion of the wall of the holder on the entire length of the forefinger of the user's hand; resting the user's thumb on the top portion of the wall of the holder adjacent to the opening; and lifting the container by supporting the holder on the forefinger of the user's hand avoiding a forceful grip with the fingers, the palm and the thumb.

There is further disclosed, a container to be held by the hand of a user including a holder formed on an outer wall of the container. The holder has an upper leg, a lower leg and a wall therebetween. The holder is disposed radially of the outer wall of the container. A chamber having an opening is formed between the holder and the outer wall of the container. The holder has an end distal from the opening. The distal end is tapered and connected to the outer wall of the container. When the user's hand is inserted in the opening and received in the chamber, the user's hand is substantially in a natural, at rest, open position such that a forceful grip is not necessary to pick up and hold the container.

In still further accordance with the teachings of the present invention, there is disclosed a non-grip holder adapted to be attached to an outer wall of a zarf. The zarf is to be held and controlled by the hand of a human user. The holder has an upper leg, a lower leg and a wall therebetween. The holder is disposed radially of the outer wall of the zarf. A chamber having an opening is formed between the holder and the outer wall of the zarf. The chamber has dimensions to accommodate the hand of the user. When the user's one hand is inserted in the opening and received in the chamber, the user's one hand is substantially in a natural, at rest, open position with the palm and the extended fingers of the user's one hand being around the outer wall of the zarf. When the zarf is inverted, and the user's opposite hand is inserted in the opening and received in the chamber, the user's opposite hand is substantially in a natural, at rest, open position with the palm and the extended fingers of the user's opposite hand being around the outer wall of the zarf such that a forceful grip is not necessary to pick up and hold the zarf with either hand.

In still further accordance with the teachings of the present invention, there is disclosed a non-grip holder adapted to be attached to an outer wall of a container. The outer wall of the container is substantially cylindrical. The container is to be held and controlled by the hand of a human user. The holder has an upper leg, a lower leg and a wall therebetween. The holder is disposed radially of the outer wall of the container. A chamber having an opening is formed between the holder and the outer wall of the container, the chamber having dimensions to accommodate the hand of the user. When the user's hand is inserted in the opening and received in the chamber, the user's hand is substantially in a natural, at rest, open position with the palm and the extended fingers of the user's hand being around the outer wall of the container such that a forceful grip is not necessary to pick up, hold and use the container.

In still another aspect, there is disclosed a non-grip container normally intended to contain a given amount of material. The non-grip container has a top portion and a bottom portion and further has an outer wall which is cylindrical or otherwise tapers from the top portion of the non-grip container to the bottom portion thereof. A holder for the non-grip container includes at least a top wall connected to the outer wall of the non-grip container and projecting radially outwardly therefrom and terminating in an outermost portion thereof. The holder further includes a side wall projecting downwardly from the outermost portion of the top wall, such that a chamber is formed which is defined by the downwardly-projecting side wall of the holder, the top wall of the holder, and the outer wall of the non-grip container, respectively. In this manner, a vertical section between the downwardly-projecting side wall of the holder and the outer wall of the non-grip container comprises a pair of substantially straight parallel lines. The user's hand is received within the chamber of the holder for the non-grip container, such that the top wall of the holder is supported upon the top of the forefinger and at least a portion of the top of the user's hand. The respective inner portions of the user's fingers and at least a portion of the user's palm are substantially adjacent to the outer wall of the non-grip container. The respective outer portions of the user's fingers and at least a portion of the back of the user's hand are substantially adjacent to the downwardly-projecting side wall of the holder. The user's hand is comfortably cradled within the chamber for a relaxed retention and control of the non-grip container without the necessity for any rigid gripping action. The cross-sectional area of the chamber is substantially 36% to 155% of the cross-sectional area of the non-grip container taken across a horizontal plane.

These and other objects of the present invention will become apparent from a reading of the following specification taken in conjunction with the enclosed drawings.

DESCRIPTION

Figure 1:
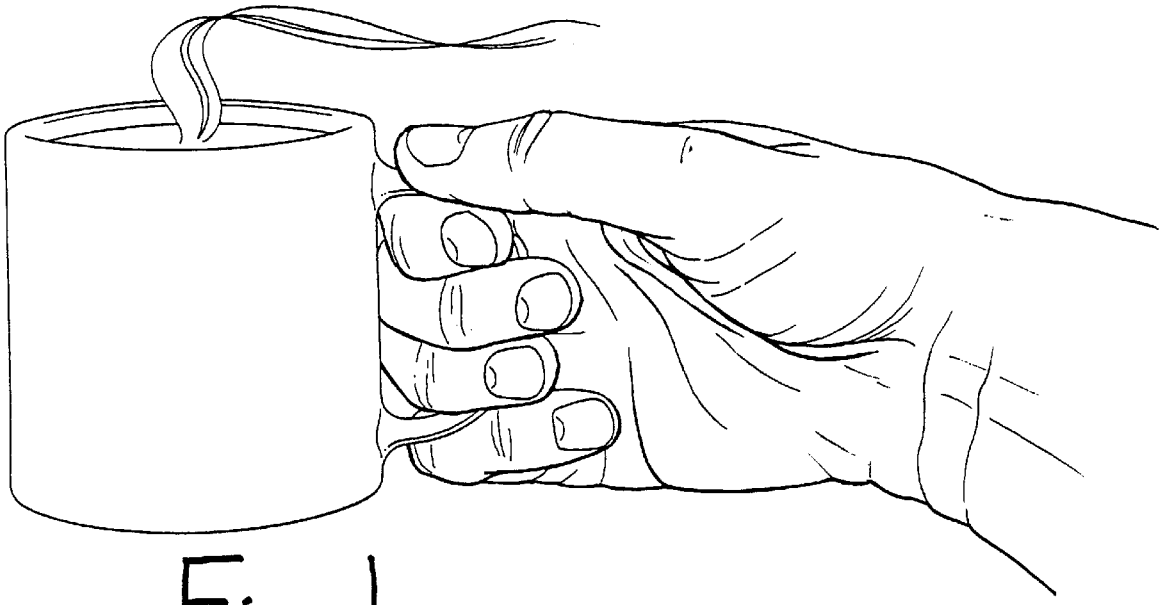
Fig. 1 Prior Art
FIG. 1 is a pictorial view of the prior art showing the handle of the cup in the grasp of the user's hand.
Figure 2:
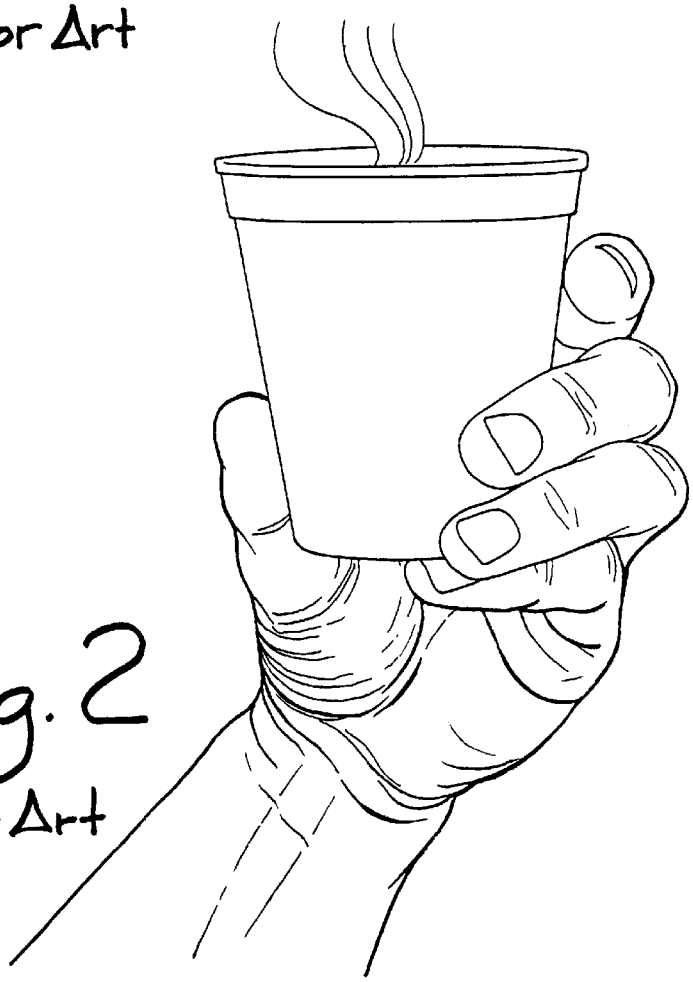
Fig. 2 Prior Art
FIG. 2 is a pictorial view of the prior art showing the tapered cup without a handle grasped in the user's hand.
Figure 3:
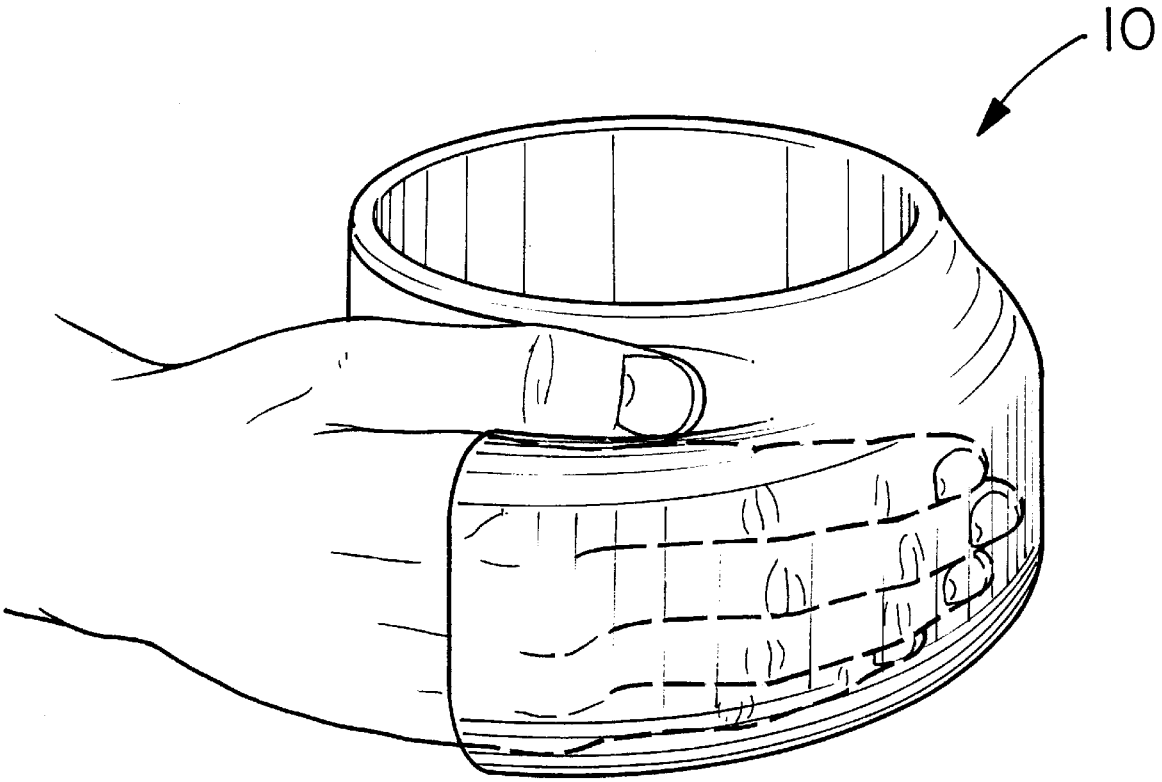
FIG. 3 is a pictorial view of the present invention being held without a forceful grip by a user.

Referring now to the prior art as shown in FIGS. 1 and 2, a container, such as a cup is held by the user with several of the user's digits inserted through the opening between the ear on the cup and the container portion of the cup. The ear of the cup is grasped between the digits and the palm of the hand with the remaining digits clenched against the palm of the hand. Those containers without an ear are gripped between the digits of the user's hand which encircle the container and squeeze the container against the palm of the user's hand. Generally, the container without an ear has an outer wall which is wider at the top and narrower at the bottom, being tapered to facilitate the user's grip and to reduce the possibility of spilling the liquid contents of the container.

The container having the holder of the present invention does not require a forceful grip but rather is held with minimal expenditure of energy and effort while maintaining complete control of the container with contents therein (FIGS. 3–10). In a preferred embodiment, the container 10 has a cylindrical body 12 although the top 14 of the body 12 may be slightly wider than the bottom 16 of the body 12. The outer surface 18 of the body 12 is convex and serves as the inner wall of the holder as will be described. The contents of the container may be liquid or may be a dry pourable material such as a particulate or granular substance (e.g., sugar, coffee, flour).

An outer wall 20 of the holder is disposed radially of the outer wall of the body 12. Preferably, the outer wall 20 of the holder is substantially a U-shaped channel with a base 22, an upper leg 24 and a lower leg 26. The legs 24, 26 are joined to the respective top and bottom ends of the body 12. The outer wall 20 of the holder (the U-shaped channel) extends partially around the body 12 and is substantially a straight wall parallel to the outer wall of the body 12. The base 22 at the first end 34 of the channel is spaced away from the outer surface 18 of the body 12 and forms an opening 28 between the outer surface 18 of body 12 and the outer wall 20 of the holder. As shown in FIGS. 4–11, the opening 28 has a face in a plane substantially perpendicular to the outer wall 20 of the holder. Preferably, the channel is tapered toward the second end 36 of the outer wall 20 distal from the opening 28 such that the upper leg 24 and the lower leg 26 become progressively shorter and; at the second end 36 of the channel, the legs 24, 26 no longer exist. Alternately, the upper leg 24 and the lower leg 26 may be substantially the same height except at the second end 36 of the outer wall 20 where the legs 24, 26 are shortened to terminate the outer wall 20 (the channel) substantially against the outer surface 18 of the body 12. In this manner, a chamber 30 is formed between the body 12 and the outer wall 20 of the holder which communicates with the opening 28. In another embodiment the chamber 30 may be uniform in dimension from the opening 28 to the distal end and the upper leg 24 and lower leg 26 being of a uniform size, not being progressively shorter. The user's hand is inserted into the opening 28 and into the chamber 30. The second end of the channel 20 is at a distance from the first end such that the chamber 30 is sufficiently large to accommodate the user's hand. When so inserted, the user's hand is substantially curved in a natural, at rest, position about the convex outer surface 18 of the body 12 (i.e., the inner wall of the holder) and is adjacent to the concave inner surface of the outer wall 20 of the holder. The palm of the user's hand rests on the convex outer surface 18 of the body 12 and the back of the user's hand confronts the concave inner surface of the outer wall 20 of the holder. The leading finger of the user's hand is in contact with the inner surface of the upper leg 24 and assists in supporting the holder on the user's hand. Any or all of the digits, except the thumb, of the hand of an average size user, are received in the opening 28. If desired, the thumb is comfortably disposed on the outer surface of the upper leg 24 of the channel 20 such that the thumb does not contact the contents of the container 10. It is preferred that a depression 32 be formed on the outer surface of the upper leg 24 at the first end of the channel 20, immediately adjacent to the opening 28. The thumb rests in the depression 32 to improve the comfort of holding the container 10 however, the container 10 may be comfortably held without the thumb resting in the depression 32. The user's hand is so disposed in a natural, at rest, position. With the user's hand inserted into the holder, human effort and energy is reduced and the user may pick up and hold the container 10 without gripping the container. When so held, the user can tilt the container to drink, or to pour material, from the container 10, still without gripping the container and with minimal expenditure of energy. The present invention can be used by persons whose digits are missing due to amputation or congenital reasons and also by persons whose digits are abnormal due to deformity, illness, etc.

Figure 4:
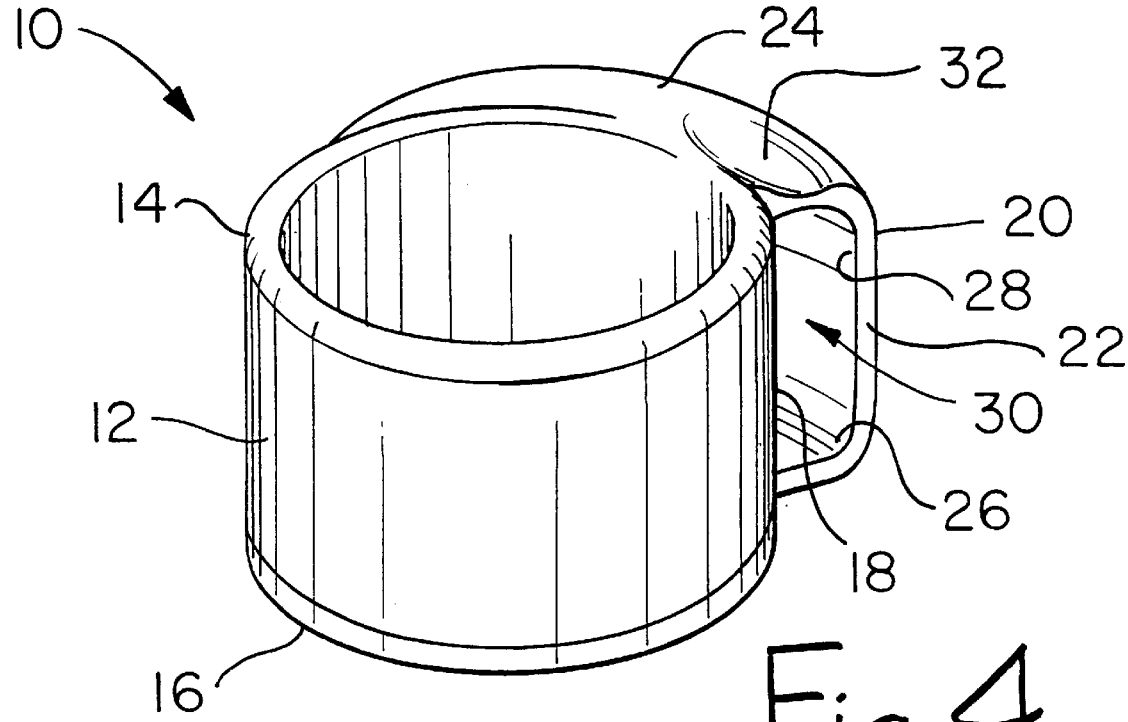
FIG. 4 is a perspective view of the present invention to be held by the right hand.
Figure 5:
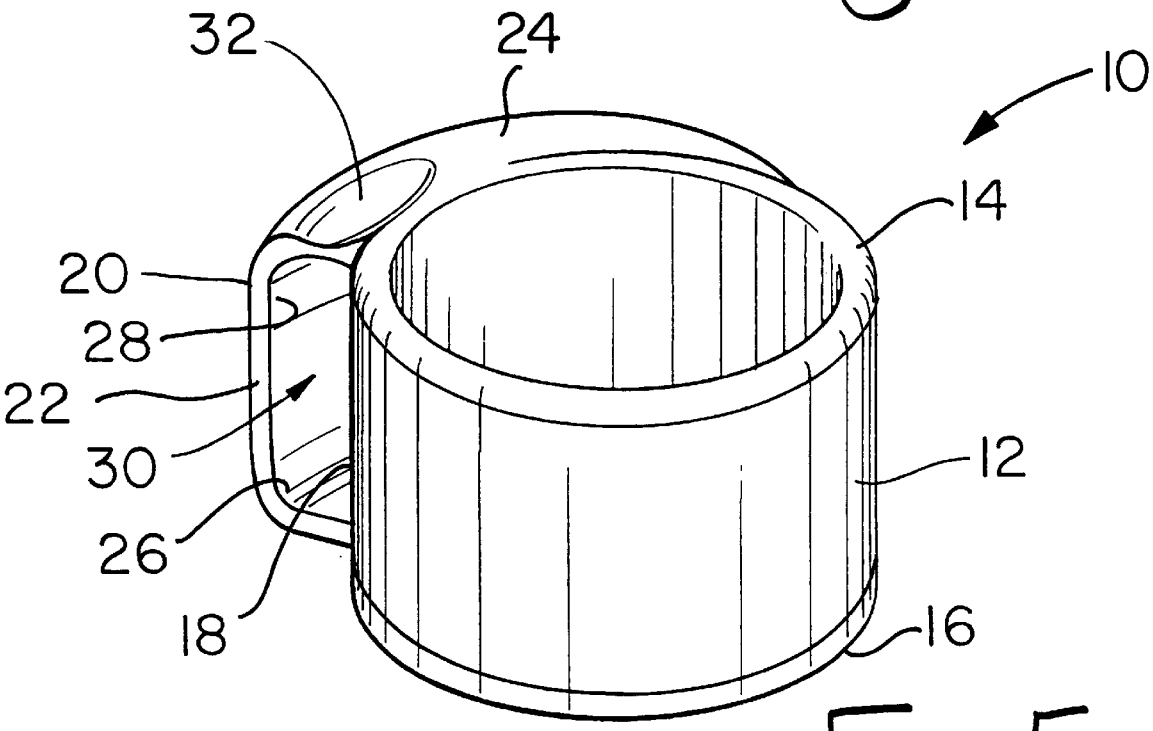
FIG. 5 is a perspective view of the present invention to be held by the left hand.
Figure 6:
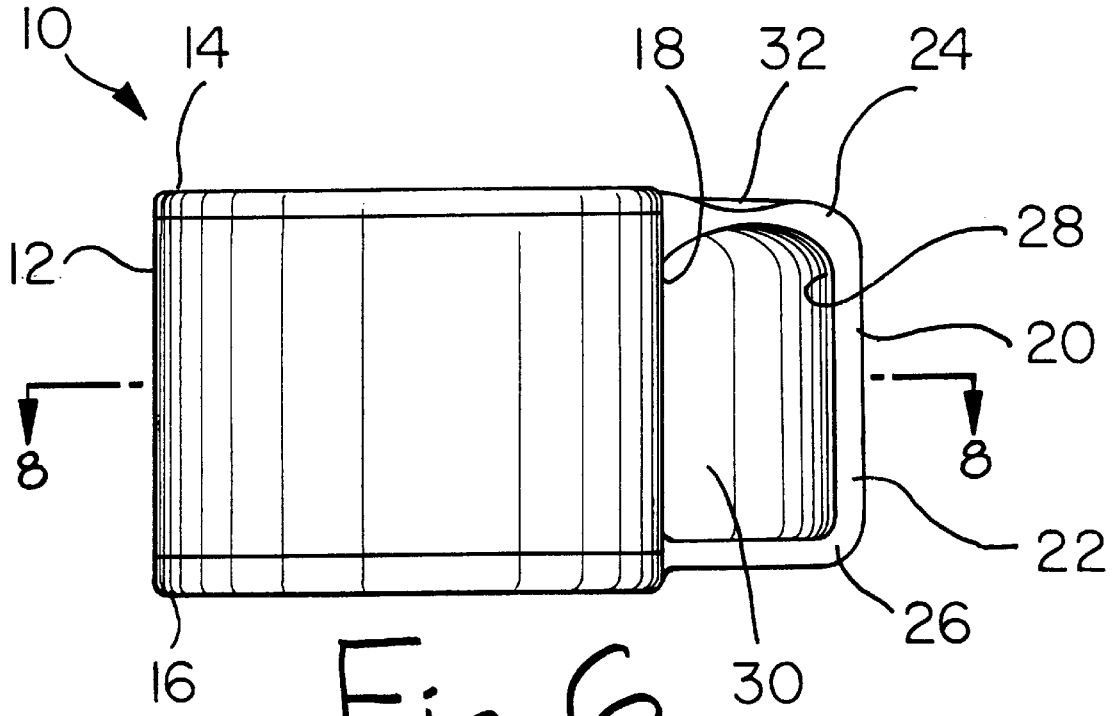
FIG. 6 is front view of the present invention showing the opening into which the users hand is inserted.
Figure 7:
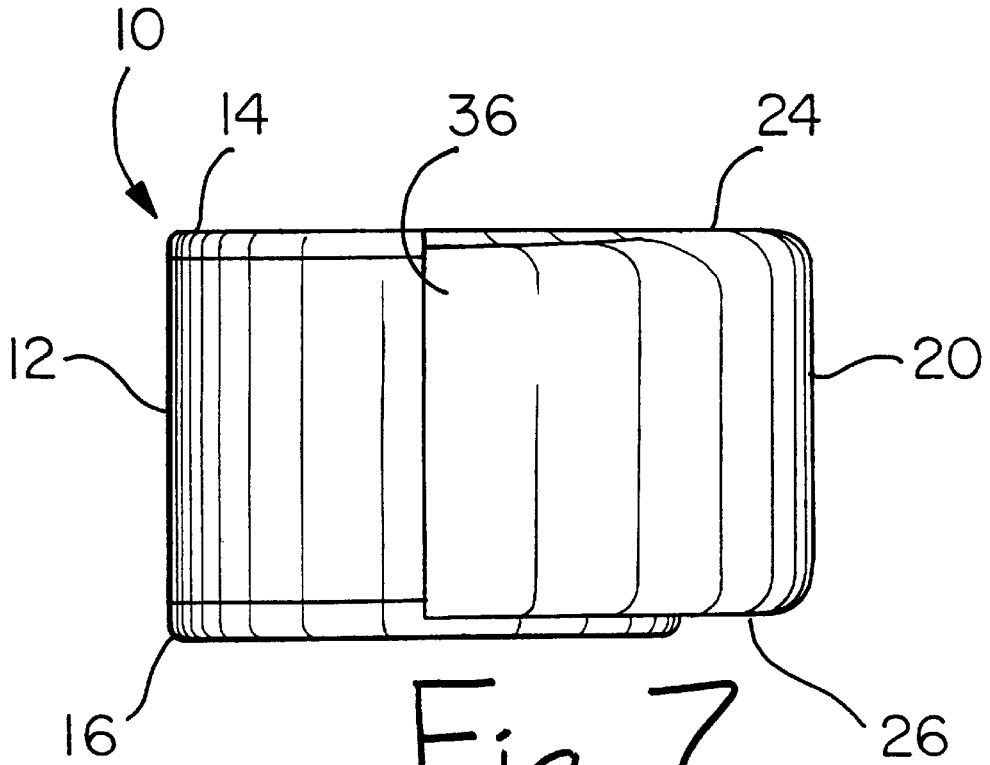
FIG. 7 is a rear view of the present invention.
Figure 8:
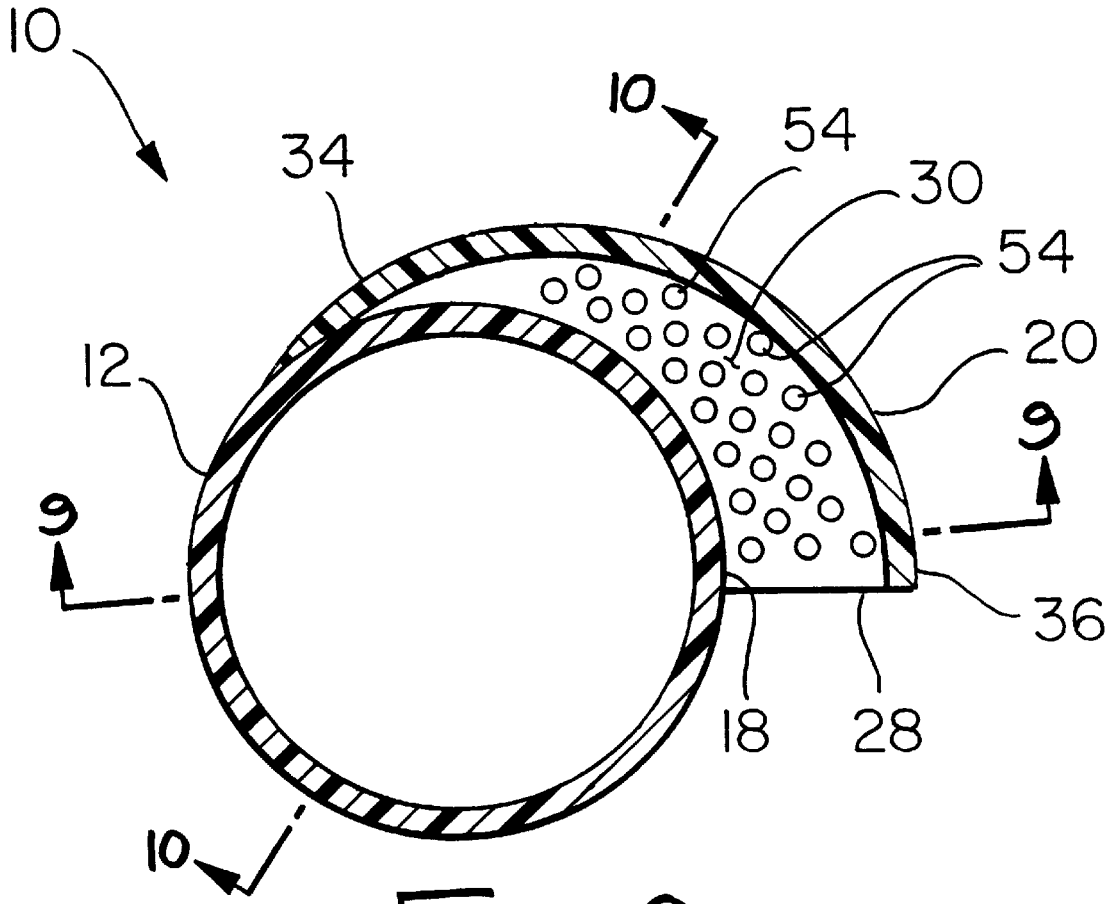
FIG. 8 is a cross-sectional view taken across the lines 8—8 of FIG. 7.
Figure 9:
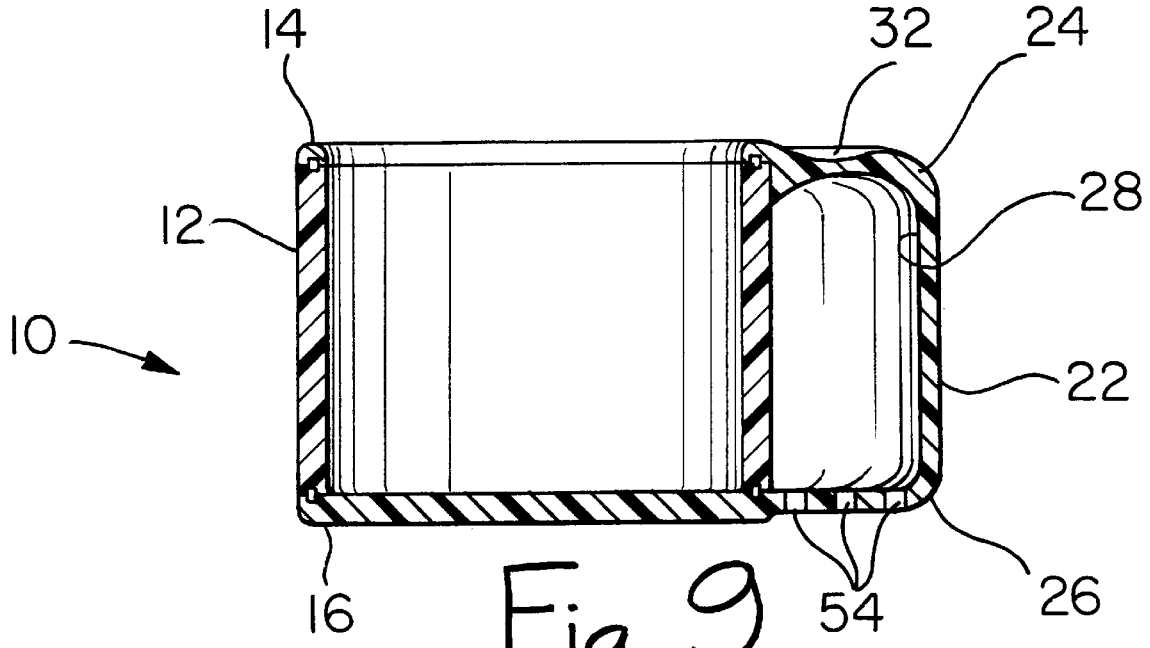
FIG. 9 is a cross-sectional view taken across the lines 9—9 of FIG. 8.
Figure 10:
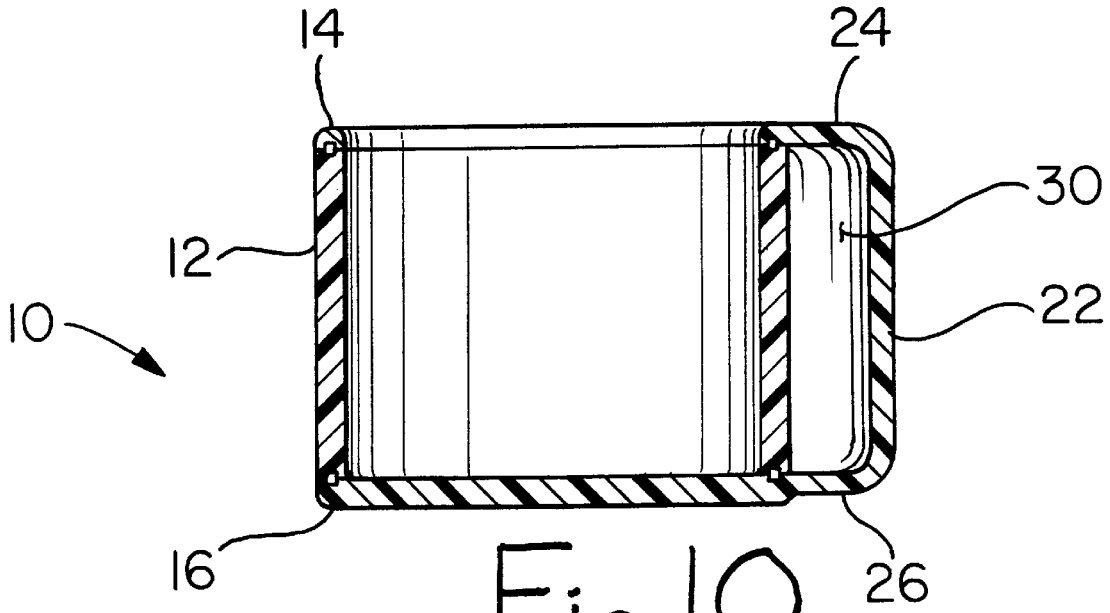
FIG. 10 is a cross-sectional view taken across the lines 10—10 of FIG. 8.
Figure 11:
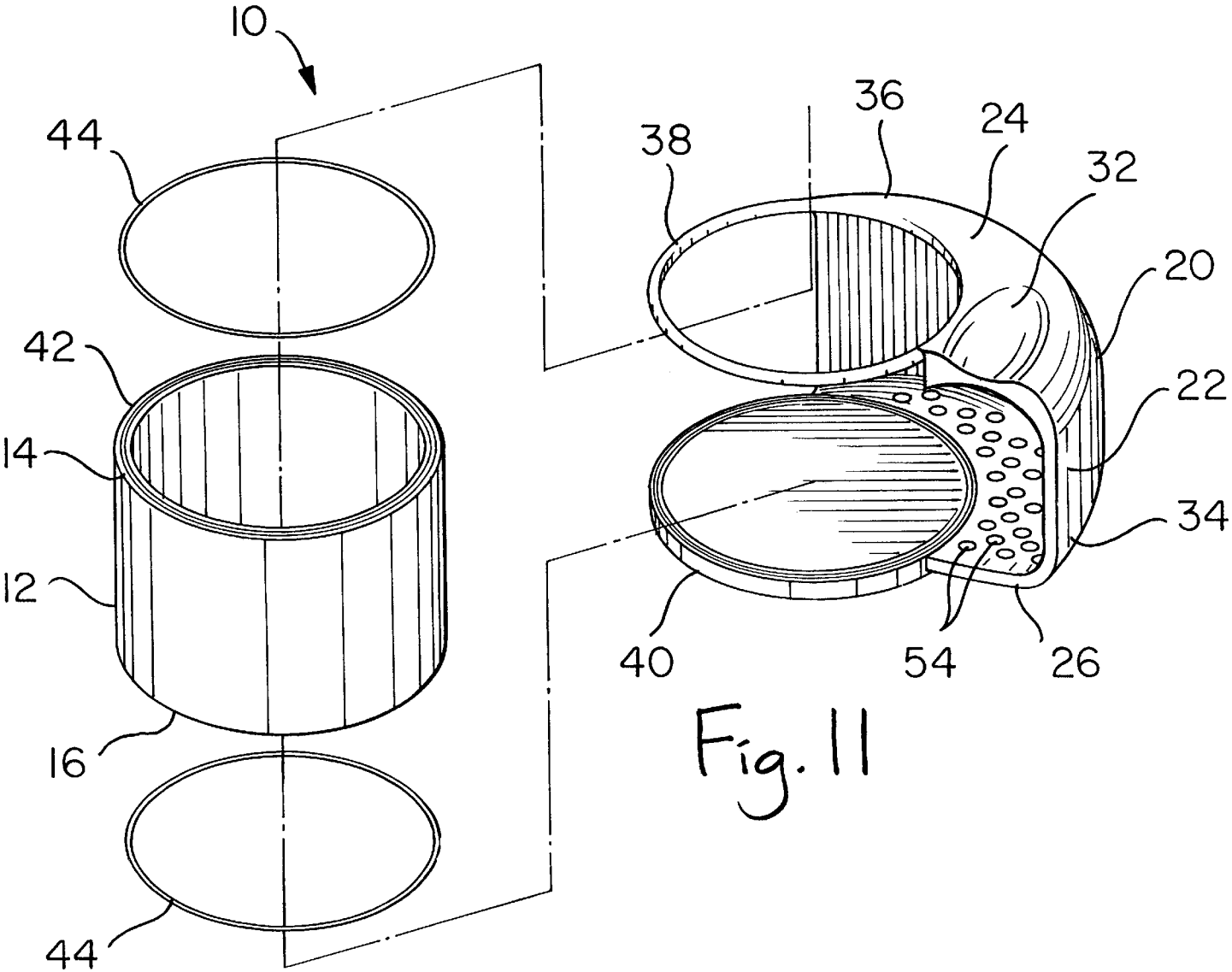
FIG. 11 is an exploded perspective view of the present invention.
Figure 12:
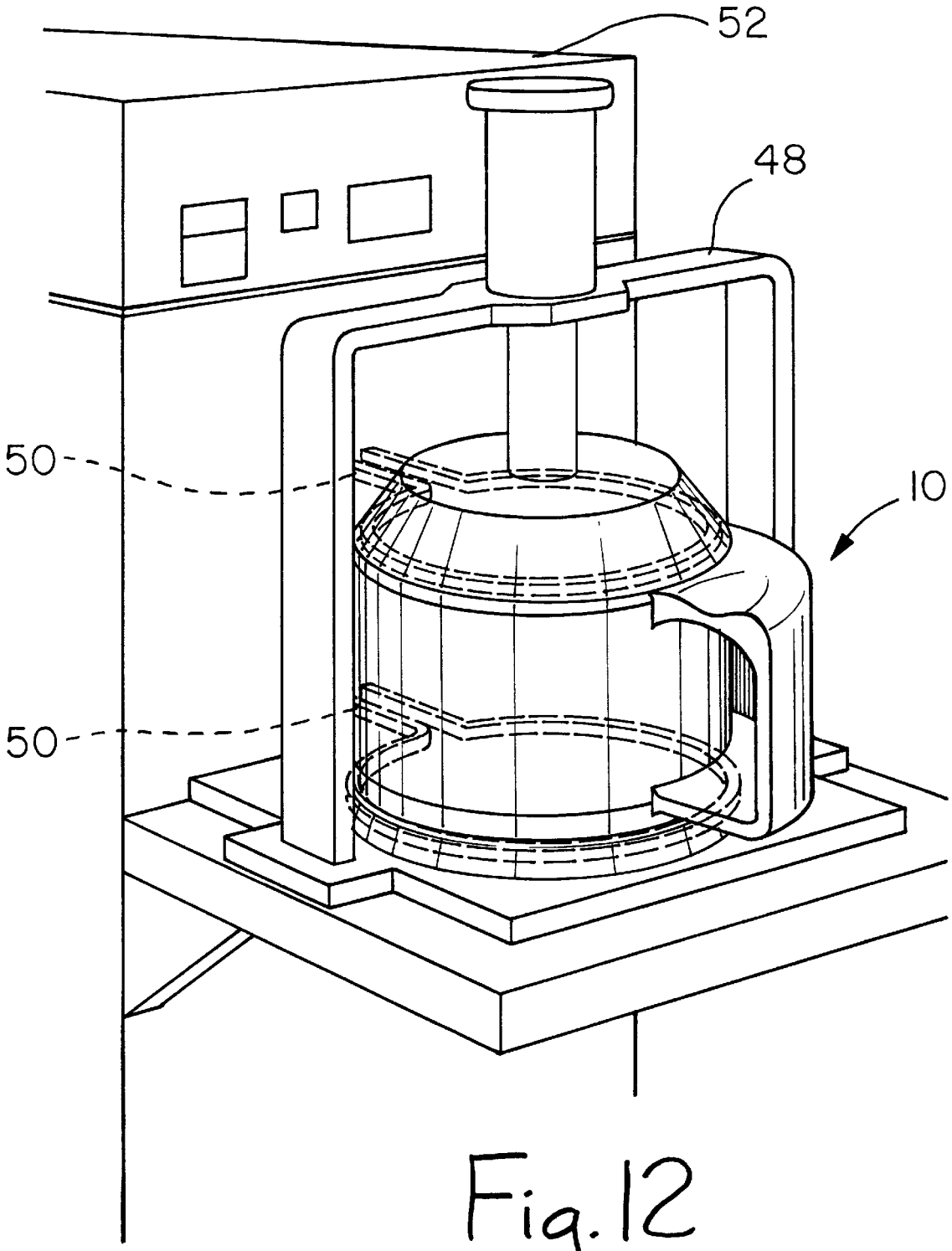
FIG. 12 is a perspective view of the present invention being held in a fixture for electromagnetically welding the components of the present invention.
Figures 13, 14, 15:
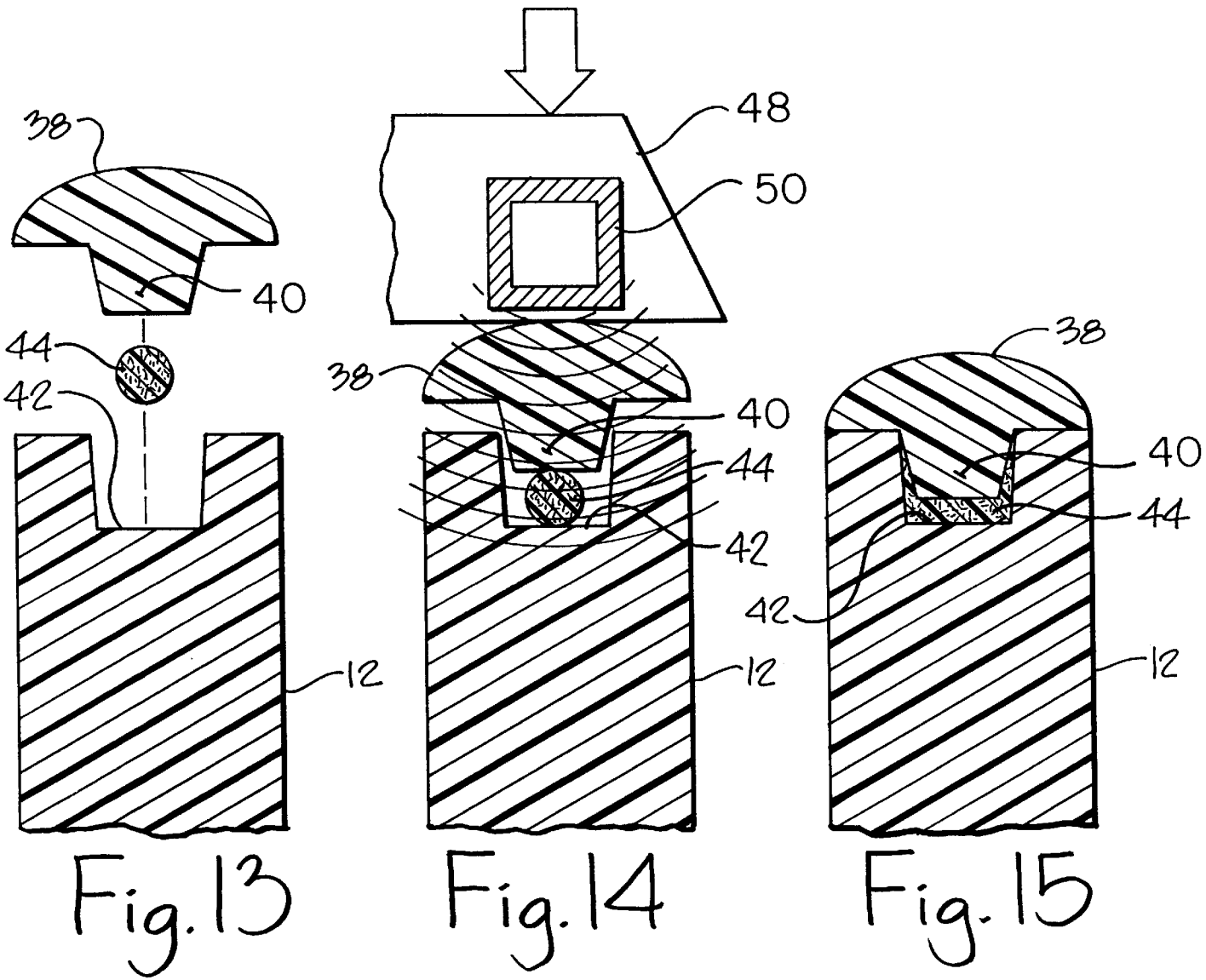
FIG. 13 is an enlarged cross-sectional view showing the disposition of the magnetically active material between the components of the present invention.
FIG. 14 is an enlarged cross-sectional view showing the present invention held in the fixture and the application of an electromagnetic field to the device.
FIG. 15 is an enlarged cross-sectional view of the electromagnetically welded interface between components of the present invention.
Figure 16:
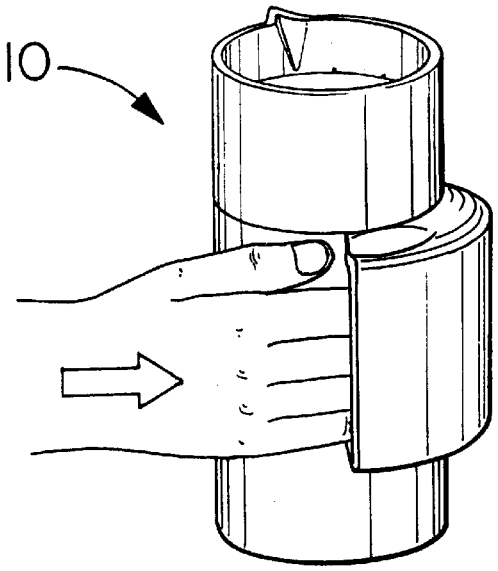
FIG. 16 is a perspective view of a user's hand being inserted into the opening of the holder of the present invention formed on a pitcher.
Figure 17:
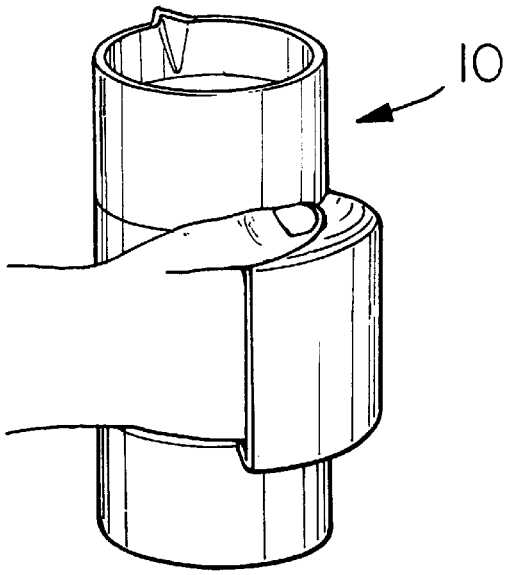
FIG. 17 is a perspective view of the pitcher of FIG. 16 being held by the user.
Figure 18:
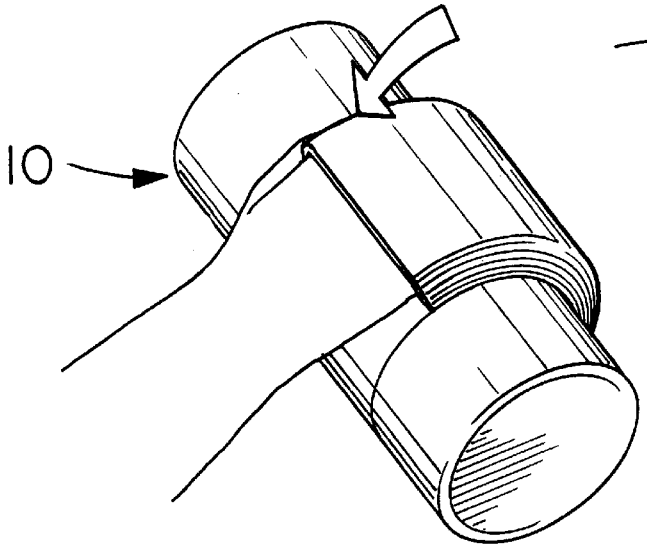
FIG. 18 is a perspective view of the pitcher of FIG. 16 being tilted for pouring.

The holder may be formed and connected to the container 10 such that the outer wall 20 extends in a counterclockwise direction from the opening 28 to accept the right hand of the user. Alternately, the holder may be formed and connected to the container 10 such that the outer wall 20 extends in a clockwise direction from the opening 28 to accept the left hand of the user (FIGS. 4 and 5).

For calculation purposes, the following dimensions were used for the containers:

| Container | Height (in.) | Inner Diameter (in.) | Cross-sectional area (sq. in.) |
|---|---|---|---|
| 8 oz. | 3 | 2 ½ | 4.9 |
| 12 oz. | 3 ½ | 2 ⅞ | 6.1 |
| 16 oz. | 3 ¾ | 3 ⅛ | 7.6 |

It is recognized that a container of any given volume may have a height and diameter which differs from the above values. However, in order to limit the calculations, the above values, which are typical, have been used.

Figure 25:
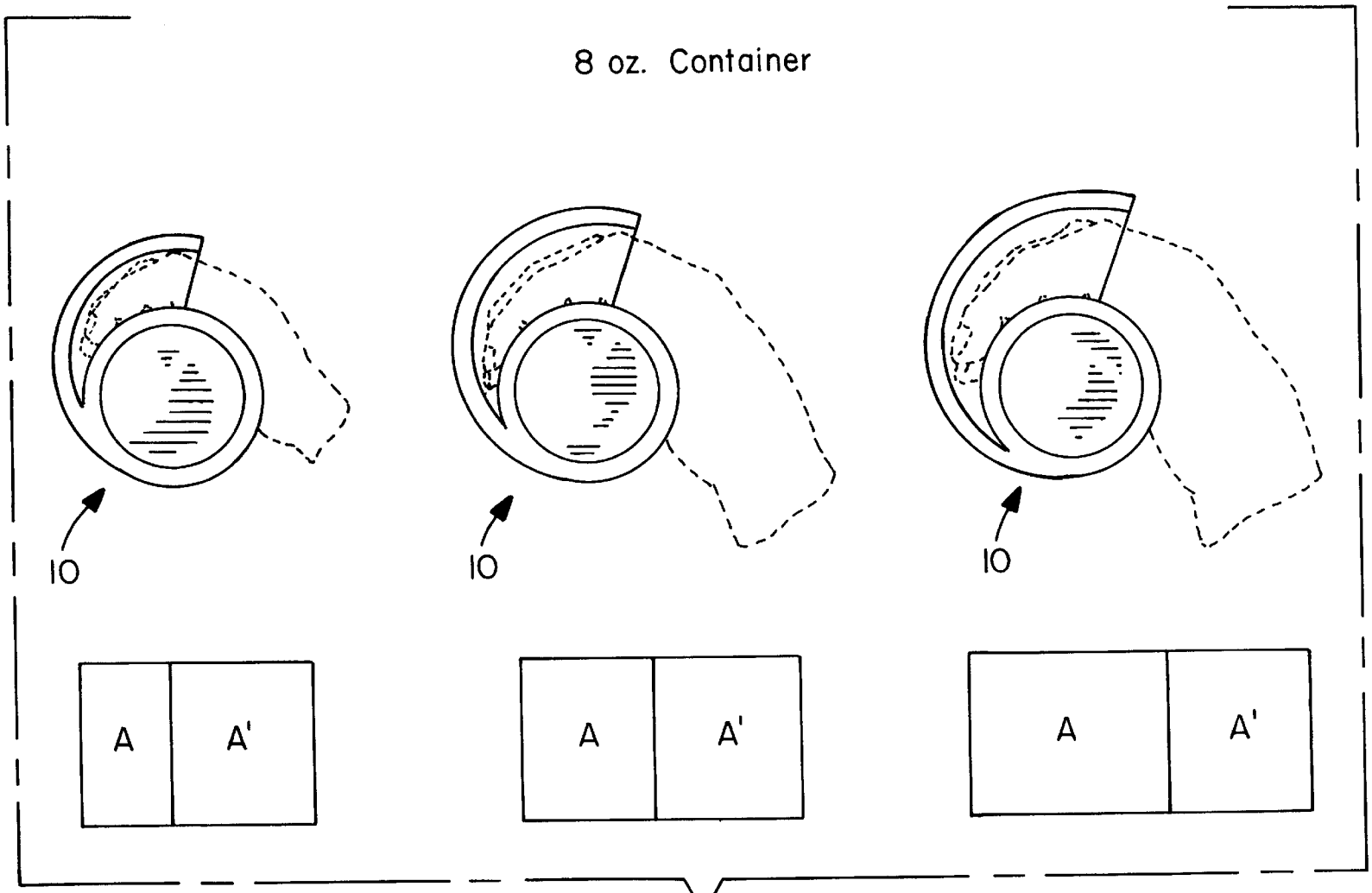
FIG. 25 is a comparative diagram showing a top plan view of an 8 oz. container having a holder for a small, a medium and a large hand formed thereon, the hand being shown in broken lines within the holder and the comparative cross-sectional areas of the holder and the holder and the container shown in block form.
Figure 26:
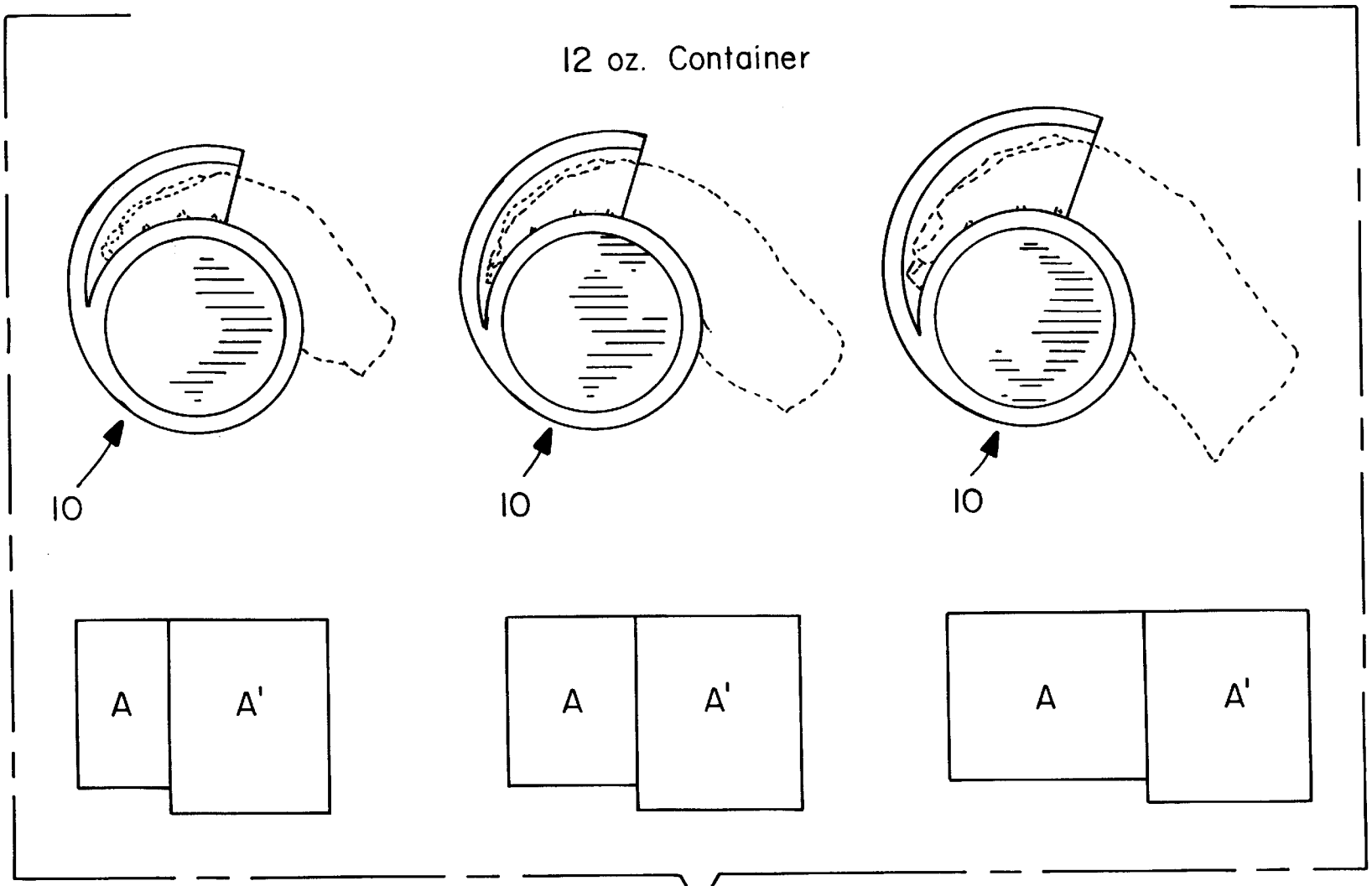
FIG. 26 is the same as FIG. 25 for a 12 oz. container.
Figure 27:
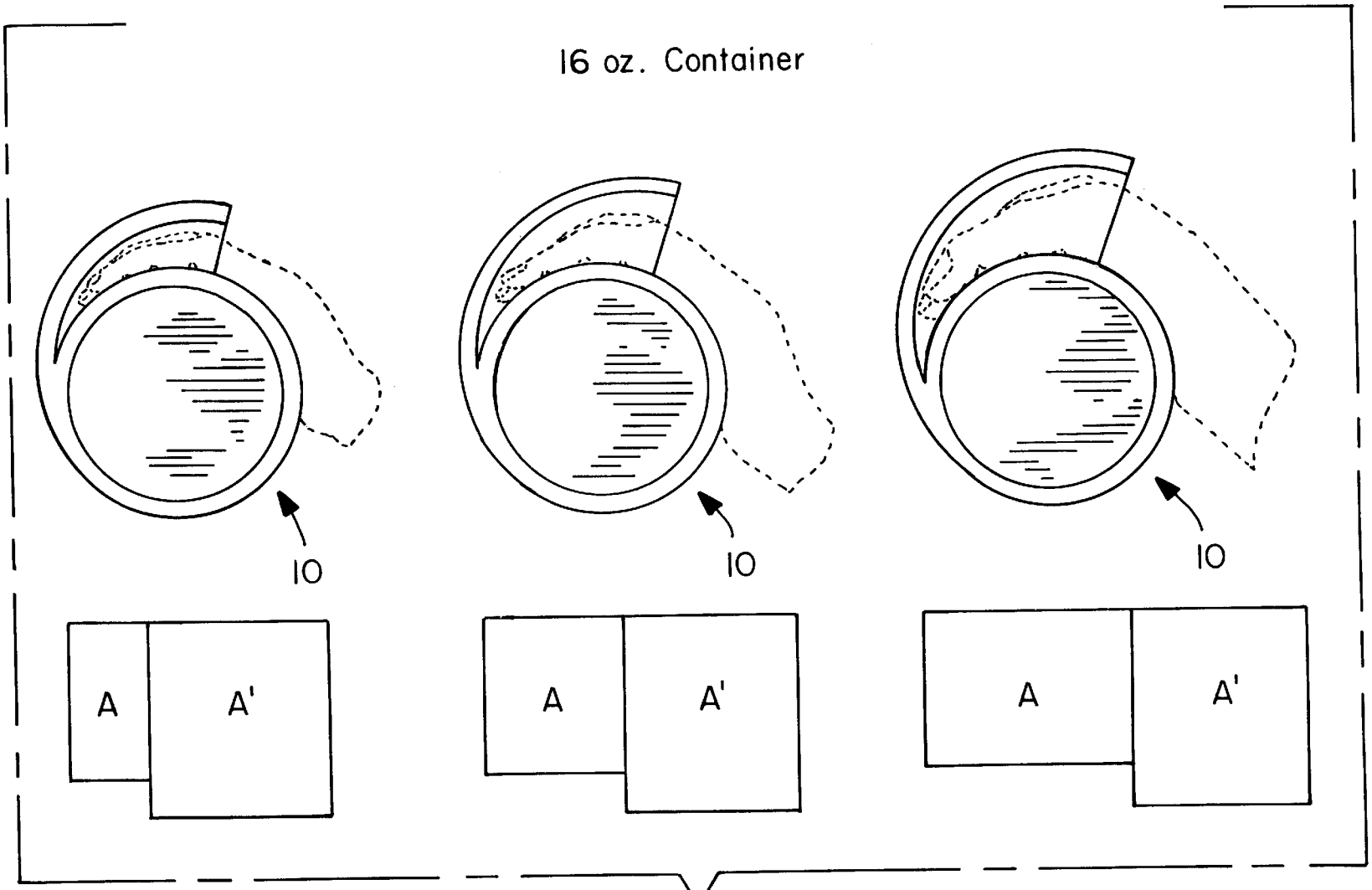
FIG. 27 is the same as FIG. 25 for a 16 oz. container.

A relationship exists between the cross-sectional area A of the holder and the cross-sectional area A' of the container taken in a horizontal plane across the container with the holder as shown in Table I and FIGS. 25–27.

TABLE I

| | Container Size | | |
|---|---|---|---|
| | 8 oz. | 12 oz. | 16 oz. |
| $\frac{A}{A'}$ small hand | $\frac{2.7}{4.9} = 0.55$ | $\frac{2.7}{6.1} = 0.44$ | $\frac{2.7}{7.6} = 0.36$ |
| $\frac{A}{A'}$ medium hand | $\frac{4.7}{4.9} = 0.96$ | $\frac{4.7}{6.1} = 0.77$ | $\frac{4.7}{7.6} = 0.62$ |
| $\frac{A}{A'}$ large hand | $\frac{7.6}{4.9} = 1.55$ | $\frac{7.6}{6.1} = 1.25$ | $\frac{7.6}{7.6} = 1.0$ |

In the FIGS. 25–27, the user's hand is shown in broken lines within the holder with all of the user's knuckles fully received in the holder and the fingers fully extended with the palm of the hand contacting the outer wall 18 of the container.

Thus, it can be seen that the cross-sectional area A of the holder is at least approximately ⅓ of the cross-sectional area A' of a 16 oz. container taken across a horizontal plane and may be approximately equal to the cross-sectional area A' of the 16 oz container. The ratio of A/A' is dependent upon whether the holder is sized to accommodate a small hand or a large hand. Similarly, for an 8 oz. container, the cross-sectional area of the holder with respect to the cross-sectional area container may vary from approximately ½ to 1½.

In practice, it is less economical to fabricate holders of varying sizes and a holder to accommodate a large hand is the preferred configuration since all size hands can utilize the largest non-grip holder on any size container.

The present invention is in contrast to the prior art such as U.S. Pat. No. Des 153,867 to Macaulay. A model of the Macaulay cup was fabricated by the applicant in accordance with the drawings in the patent. The cup had a volume of approximately 16 oz. by actual volumetric measurement. The volume of the holder by actual volumetric measurement was approximately 1 oz. Thus, the volume of the holder is approximately 7% of the volume of the container. Thus, the cup and holder in U.S. Pat. Des No. 153,867 is significantly different from the cup and holder of the present invention. It is further noted that the holder in the Macaulay device cannot receive even the small hand in the manner taught by the present invention. The manner of holding the Macaulay device is with the palm of the hand on the exterior of the holder and with the fingers inserted into the chamber between the holder and the container. The container of Macaulay is held in a manner similar to that disclosed in FIG. 2 of U.S. Pat. No. 2,586,19 to Backus.

The container 10 with the holder thereon may be formed from any type of material including ceramic, glass, metal and plastic and may be a cup, a mug, a beverage container, a coffee pot, a tea pot, a carafe, a measuring cup, a pitcher, a can or a bottle.

Referring now to FIGS. 11–15 a method of forming the container 10 from plastic is shown. A cylindrical body 12 is formed having an open upper end 14. The lower end 16 of the cylindrical body may be open or may be a bottom wall as will be described. A curved U-shaped channel 20 is formed having a base 22, an upper leg 24 and a lower leg 26. It is preferred that the legs 24, 26 are substantially perpendicular to the base 22. The lengths of the legs 24, 26 are greater near the first end 34 of the channel 20 than near the second end 36 of the channel such that the first end 34 of the channel is deeper than the second end 36 of the channel. An open ring member 38 is connected to the upper leg 24 of the channel 20 and is substantially in the same plane as the upper leg 24. A circular base member 40 is connected to the lower leg 26 of the channel 20 and is substantially in the same plane as the lower leg 26. The base member 40 is an open ring if the cylindrical body 12 has a bottom wall, and the lower member 40 is a solid disc if the cylindrical body 12 has an open lower end 16. In this manner, the cylindrical body 12 forms a container with a closed bottom and an open top as will be described. The diameter of the open ring member 38 and of the base member 40 are substantially equal to the diameter of the top end 14 of the body 12 and of the bottom end 16 of the body 12, respectively. The ring member 38 is disposed immediately above and coaxial with the base member 40. The open ring member 38 is spaced apart from the base member 40 by distance approximately equal to the height of the cylindrical body 12.

Preferably a groove 42 is formed in the upper edge and in the lower edge of the cylindrical body 12. Alternately the groove 42 may be formed in the under side of the circumference of the ring member 38 and in the upper side of the circumference of the base member 40. In still another embodiment, a tongue is formed in the cylindrical body 12 or in the ring member 38 and base member 40 to be received in the opposing and corresponding groove 42. Magnetically active material 44 is placed in the respective grooves 42. This material 44 preferably has ferromagnetic particles in a thermoplastic mixture. The cylindrical body 12 is placed between the open ring member 38 and the base member 40 with the open upper end 14 of the body 12 adjacent to and cooperating with the open ring member 38 and the lower end 16 of the body 12 adjacent to the base member 40. The magnetically active material 44 is between the body 12 and the ring member 38 and base member 40 respectively. The body 12 and the channel 20 with the connected ring member 38 and base member 40 are disposed in a fixture 48 to join the components. Work coils 50 are placed near the interface between the body 12 and the members 38, 40 and energized by an induction generator 52 to produce an electromagnetic field to electromagnetically weld the body 12 to the members 38, 40 by fusing the magnetically active material 44 at the joint interface to produce a polymer to polymer linkage. The electromagnetic welding system marketed by Ashland Chemical Company under the trademark "EMA WELD" has been used successfully by the applicant. In this manner, a unitary container with holder is formed. The completed container with holder is microwavable, easily cleaned, lightweight and sturdy.

The electromagnetic welding method described herein may also be used to attach the holder to the side of a container such as a pitcher or zarf as shown in FIGS. 16–18 and 22–24.

Although electromagnetic welding is preferred, other methods known to persons skilled in the art, may be used to join the body to the holder. These include adhesives and mechanical means.

Alternately, the holder portion of the container may be formed to have a chamber 30 which has a greater width at the top than at the bottom. Thus, when the user's hand is inserted, the chamber 30 is wider to accommodate the portion of the hand nearer the thumb and narrower to receive the portion of the hand distal from the thumb. The user's hand may be disposed in, the chamber 30 even if the hand is deformed or has missing digits.

A further feature of the holder is the inclusion of a drainage means 54 to facilitate washing and cleaning of the chamber 30. The drainage means may be an opening at the second end 36 of the channel 20 or a plurality of spaced-apart openings on the outer wall 20, the upper leg 24, the lower leg 26 or both legs 24, 26.

Figure 19:
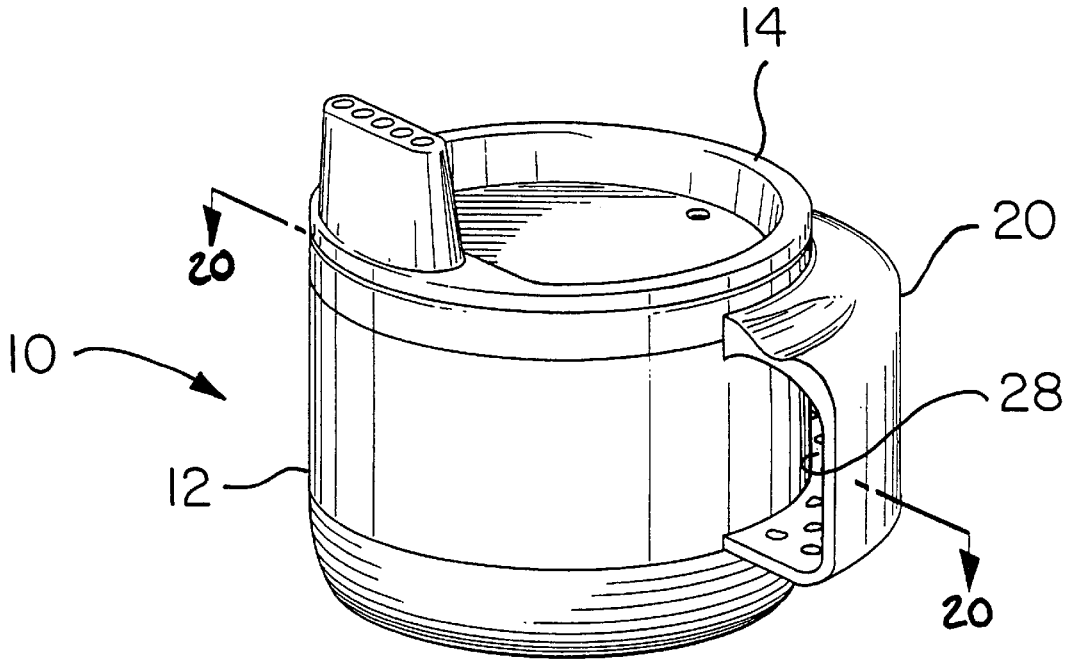
FIG. 19 is a perspective view of a child's drinking cup having two holders of the present invention formed on the cup.
Figure 20:
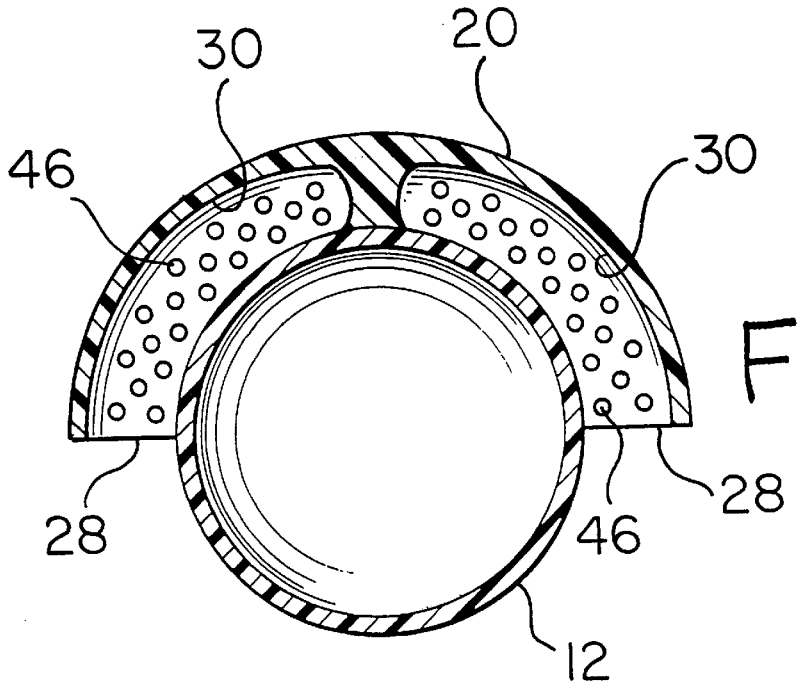
FIG. 20 is a cross-sectional view across the lines 20—20 of FIG. 19.
Figure 21:
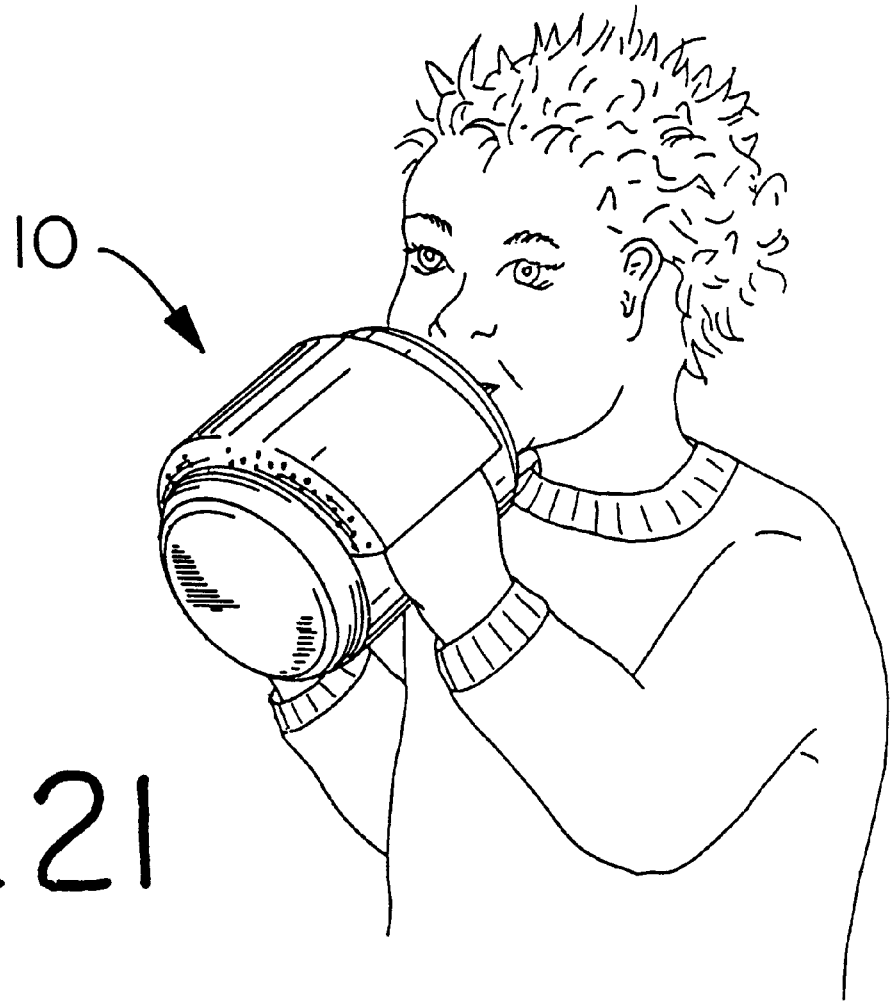
FIG. 21 is a pictorial view of a child holding and drinking from the cup of FIG. 19.

The holder may be a two-handed holder having at least one chamber 30 with two openings 28 (FIGS. 19–21). Each opening 28 communicates with the at least one chamber 30. If desired, the holder may be formed with two separate chambers 30, each chamber 30 communicating with a separate opening 28. The at least one chamber 30 (or the two separate chambers 30) is defined by an outer wail 20 and the body of the container so that the user's hands may be disposed through the openings 28 and into the at least one chamber 30 (or two chambers) in a manner identical to the single-handed holder as previously described. Thus, the user can pick up the container with both hands or, if desired, with either hand. A forceful grip is not required with either or both hands to hold the container. This embodiment is of particular use by small children or by persons having disabilities or reduced strength in their hands.

Figure 22:
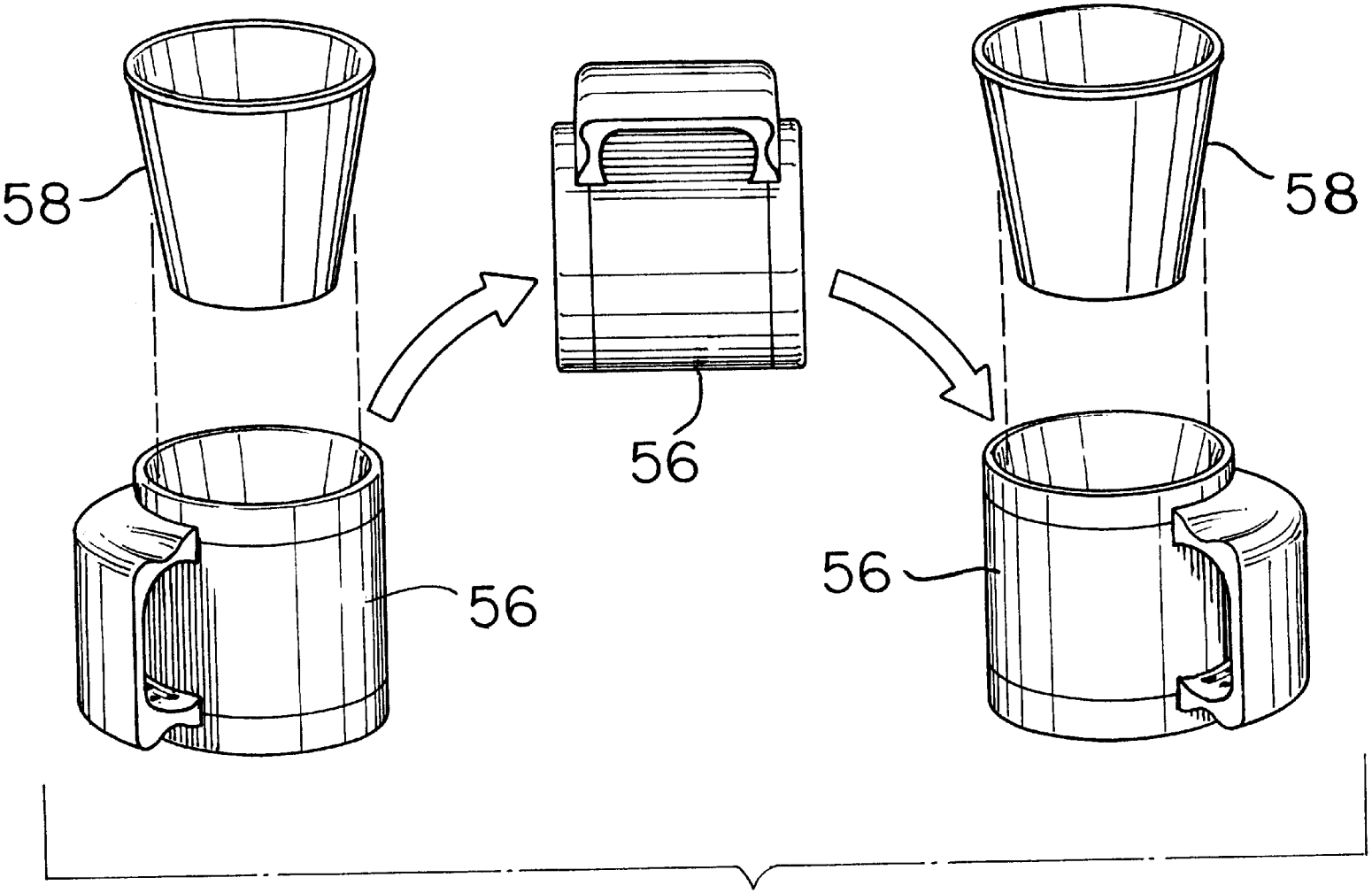
FIG. 22 is a sequence of perspective views showing a zarf having a holder of the present invention formed thereon such that the zarf may be held by either hand of the user by inversion of the zarf, and showing the receiving of the container in the zarf before and after inversion.
Figure 23:
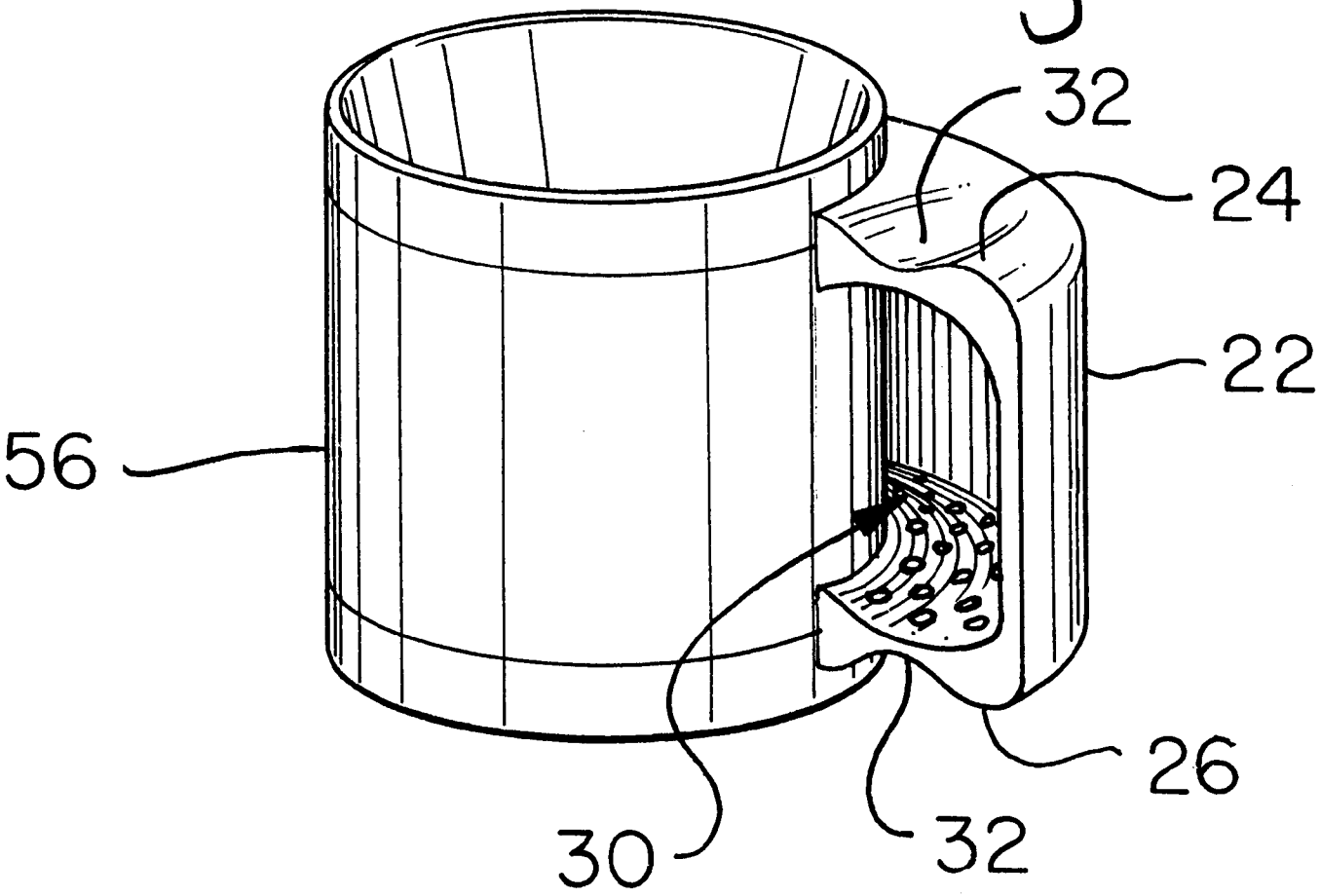
FIG. 23 is a perspective view of the zarf showing the opening to the holder.
Figure 24:
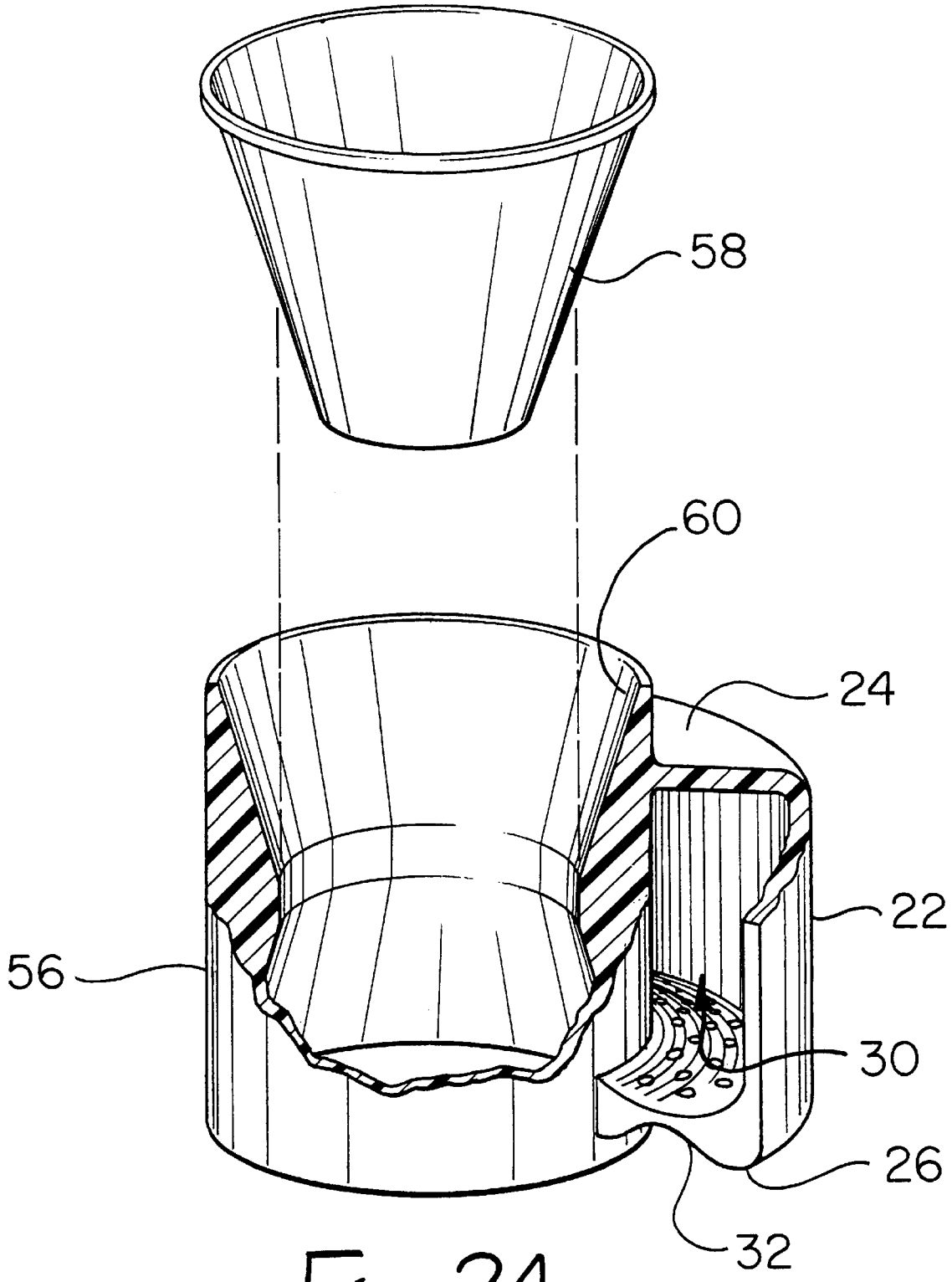
FIG. 24 is a partial cut-away perspective view of the zarf showing the holder and showing the tapered, internal wall of the zarf capable of receiving the container.

When attached to a zarf type of container 56, the holder facilitates use by either the left hand or the right hand of the user as shown in FIGS. 22–24. The left hand of the user may be inserted in the holder 11 with a replaceable container 58 for liquid held in the zarf 56 by conventional means. Inversion of the zarf 56 permits the right hand of the user to be inserted in the same holder with the replaceable container 58 for liquid being held in the opposite side of the zarf 56. The holder on the zarf 56 is substantially the same as the holder for the container described previously which has an outer wall 20, an upper leg and a lower leg, an opening, a chamber and drainage means.

The internal wall 60 of the zarf 56 is narrower in the center of the zarf 56 than it is at the outer edges and is tapered from the respective outer edges toward the center. In this manner, the replaceable container 58 may be inserted from either end of the zarf 56 and to be retained in the zarf 48 because the diameter of the narrowest portion of the internal wall 60 of the zarf 48 is less than the diameter of an intermediate portion of the replaceable container 58. Thus, the replaceable container 58 is supported in the zarf 56 with a portion of the replaceable container 58 extending above the zarf 56 with the zarf 56 in either the inverted or the normal upright disposition. The holder preferably has a depression 32 formed on each of the opposite legs 24, 26 of the holder, wherein the thumb of the right hand and the left hand respectively, are received when the respective hand holds the zarf 56. A forceful grip is not necessary to pick up and hold the zarf 56.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A non-grip container to be picked up and held by a hand of a user, said container having a convex outer wall, a holder radially disposed on the outer wall of the container, the holder comprising a wall having a substantially U-shaped cross-section including a pair of legs, the legs of the "U" joining the convex outer wall of the container, wherein a chamber is formed between the convex outer wall of the container and the wall of the holder, the chamber having an opening, the chamber being closed at a point distal from the opening, and the wall of the holder having a concave inner surface, wherein a cross-section taken in a horizontal plane across the holder and container, the ratio of the cross-sectional area of the holder with respect to the cross-sectional area of the container is greater than 0.36, whereby when the user's hand is inserted through the opening and into the chamber, the user's hand is substantially in a curved natural, at rest open position with the palm and extended fingers of the hand being disposed around the convex outer wall of the container such that human effort is substantially reduced, and such that a forceful grip is not necessary to pick up and hold the container.

2. The holder of claim 1, wherein the convex outer wall of the container joins the wall of the holder at a point distal from the opening in the chamber, the holder having a vertical dimension which is smaller than a distance from the opening to the distal point measured in a plane which is perpendicular to the vertical dimension of the holder.

3. The holder of claim 1, further comprising drainage means in the holder to permit drainage of liquid from the holder during washing of the container.

4. The holder of claim 1, wherein the wall of the holder has a top portion adjacent to the container, said top portion being supported by the extended forefinger of the user's hand along an entire length of said forefinger when the user's hand is inserted through the opening and into the chamber.

5. The holder of claim 1, wherein the wall of the holder, when looking down on the container, extends in a counter-clockwise direction from the opening to accept the right hand of the user.

6. The holder of claim 1, wherein the wall of the holder, when looking down on the container, extends in a clockwise direction from the opening to accept the left hand of the user.

7. The holder of claim 1, further comprising the wall of the holder having an upper surface adjacent to the convex outer wall of the container, a depression formed in the upper surface near the opening between the wall of the holder and the convex outer wall of the container and above the opening into the chamber, wherein the user's thumb is supported in the depression.

8. A container to be held by a hand of a user such that a forceful grip is not necessary to pick up and hold the container, the container comprising a cylinder having a circumferential wall, a bottom and an open top, an outer wall having a substantially U-shaped cross-section disposed circumferentially of the cylinder wall and having respective portions of the "U" joined substantially perpendicularly to the wall of the cylinder to form a closed chamber therebetween, the chamber having an opening, and the outer wall having a convex inner surface, whereby when the user's hand is inserted through the opening and into the chamber, the user's hand is substantially curved about the wall of the cylinder and is disposed between the convex inner surface of the outer wall and the circumferential wall of the cylinder.

9. A method of use of a container to enable said container to be picked up and held by a hand of a user such that a forceful grip is not required, wherein the container has an outer wall which is cylindrical or otherwise tapers from a top portion to a bottom portion of the container, a holder being formed on the outer wall of the container, the holder having a wall disposed radially of, and substantially parallel to, the wall of the container, such that a closed chamber having an opening is formed between the outer wall of the container and the wall of the holder, and the wall of the holder having a top portion adjacent to the container, the method comprising the steps of:

inserting the extended fingers and the palm of the user's hand into the opening, the extended fingers and the palm of the user's hand being received within the chamber supporting the top portion of the wall of the holder on the entire length of the forefinger of the user's hand, resting the user's thumb on the top portion of the wall of the holder adjacent to the opening, and lifting the container by supporting the holder on the forefinger of the user's hand, thereby avoiding a forceful grip with the fingers, the palm and the thumb.

10. A container to be held by the hand of a user, the container having an outer wall, comprising a holder formed on an outer wall of the container, the holder having an upper leg, a lower leg and a wall therebetween, the holder being disposed radially of the outer wall of the container, the wall of the holder being substantially parallel to the outer wall of the container when viewed in a vertical section of the container, a chamber having an opening being formed between the holder and the outer wall of the container, the holder having an end distal from the opening, the distal end being tapered and connected to the outer wall of the container, whereby, when the user's hand is inserted through the opening and is received in the chamber, the user's hand is substantially in a natural, at rest, open position such that a forceful grip is not necessary to pick up and hold the container.

11. The container of claim 10, further having drainage means formed in the holder to permit drainage of liquid from the holder during washing of the container.

12. A non-grip holder adapted to be attached to an outer wall of a container, the outer wall of the container being substantially cylindrical, the container to be held and controlled by the hand of a human user, the holder comprising:

an upper leg, a lower leg and a wall therebetween, the holder being disposed radially of the outer wall of the container, a chamber having an opening formed between the holder and the outer wall of the container, the chamber having dimensions to accommodate the hand of the user, wherein in a cross-section taken in a horizontal plane across the holder and container, the ratio of the cross-sectional area of the holder with respect to the cross-sectional area of the container is greater than 0.36.

whereby when the user's hand is inserted through the opening and is received in the chamber, the user's hand is substantially in a natural, at rest, open position with the palm and the extended fingers of the user's hand being disposed around the outer wall of the container, such that a forceful grip is not necessary to pick up, hold and use the container.

13. The holder of claim 12, wherein the outer wall of the container joins the wall of the holder at the point distal from the opening to the chamber, the holder having a height between the lower leg and the upper leg which is smaller than a distance from the opening to the distal point.

14. The holder of claim 12, further having drainage means formed in the holder to permit drainage of liquid from the holder when the container is washed.

15. The holder of claim 12, wherein the upper leg of the holder has a length whereby said upper leg of the holder is supported underneath by the extended forefinger of the user's hand along an entire length of said forefinger.

16. The holder of claim 12, wherein the wall of the holder, when viewed looking down, extends in a counterclockwise direction from the opening to accept the right hand of the user.

17. The holder of claim 12, wherein the wall of the holder, when viewed looking down, extends in a clockwise direction from the opening to accept the left hand of the user.

18. The holder of claim 12, further comprising the legs of the holder being progressively shorter from the opening in the chamber to a point distal from the opening such that the chamber is tapered towards the distal point.

19. The holder of claim 12, wherein the legs of the holder are perpendicular to the outer wall of the container, thereby forming a U-shaped cross-section, the opening having a face in a plane perpendicular to the outer wall of the container.

20. The holder of claim 12, wherein the wall of the holder is substantially parallel to the cylindrical outer wall of the container when viewed in a vertical section of the container.

21. The holder of claim 12, wherein the upper leg of the holder has a depression formed therein near the opening, such that the user's thumb is supported in the depression when the container is picked up, held and used by the user.

22. The holder of claim 12, wherein the ratio of the cross-sectional area of the holder with respect to the cross-sectional area of the container taken in a horizontal plane across the holder and container, ranges from 0.36 to 1.55.

23. A non-grip container normally intended to contain a given amount of material, the non-grip container having a top portion and a bottom portion and further having an outer wall which is cylindrical or otherwise tapers from the top portion of the non-grip container to the bottom portion thereof, a holder for the non-grip container, the holder including at least a top wall connected to the outer wall of the non-grip container and projecting radially outwardly therefrom and terminating in an outermost portion thereof, the holder further including a side wall projecting downwardly from the outermost portion of the top wall, such that a chamber is formed which is defined by the downwardly-projecting side wall of the holder, the top wall of the holder, and the outer wall of the non-grip container, respectively, and such that a vertical section between the downwardly-projecting side wall of the holder and the outer wall of the non-grip container comprises a pair of substantially straight parallel lines, wherein the user's hand is received within the chamber of the holder for the non-grip container, such that the top wall of the holder is supported upon the top of the forefinger and at least a portion of the top of the user's hand, such that the respective inner portions of the user's fingers and at least a portion of the user's palm are substantially adjacent to the outer wall of the non-grip container, and such that the respective outer portions of the user's fingers and at least a portion of the back of the user's hand are substantially adjacent to the downwardly-projecting side wall of the holder, wherein the user's hand is comfortably cradled within the chamber for a relaxed retention and control of the non-grip container without the necessity for any rigid gripping action, and wherein a cross-sectional area of the chamber is substantially 36% to 155% of a cross-sectional area of the non-grip container taken across a horizontal section of the holder and the non-grip container.

* * * * *